US008152562B2

(12) United States Patent
Gross

(10) Patent No.: US 8,152,562 B2
(45) Date of Patent: Apr. 10, 2012

(54) CABLE PANEL MOUNT

(75) Inventor: Charles M. Gross, York, PA (US)

(73) Assignee: FCI Americas Technology LLC, Carson City, NV (US)

( * ) Notice: Subject to any disclaimer, the term of this patent is extended or adjusted under 35 U.S.C. 154(b) by 45 days.

(21) Appl. No.: 12/417,316

(22) Filed: Apr. 2, 2009

(65) Prior Publication Data

US 2010/0255714 A1 Oct. 7, 2010

(51) Int. Cl.
*H01R 4/50* (2006.01)

(52) U.S. Cl. ..... 439/533; 439/374

(58) Field of Classification Search ..... 439/247, 439/544, 569, 533

See application file for complete search history.

(56) References Cited

U.S. PATENT DOCUMENTS

| | | | | |
|---|---|---|---|---|
| 3,711,816 | A * | 1/1973 | Schumacher | 439/352 |
| 4,422,706 | A * | 12/1983 | Neuhouser | 439/465 |
| 4,572,602 | A * | 2/1986 | Rupnik | 439/350 |
| 4,647,128 | A * | 3/1987 | Maros | 439/350 |
| 4,756,695 | A | 7/1988 | Lane et al. | |
| 4,812,133 | A * | 3/1989 | Fleak et al. | 439/248 |
| 4,859,201 | A | 8/1989 | Marsh | |
| 4,986,763 | A * | 1/1991 | Boyle | 439/165 |
| 4,990,094 | A | 2/1991 | Chandler et al. | |
| 5,649,834 | A * | 7/1997 | Allison et al. | 439/247 |
| 6,149,315 | A | 11/2000 | Stephenson | |
| 6,254,278 | B1 | 7/2001 | Andrews et al. | |
| 6,280,228 | B1 * | 8/2001 | Maciejewski et al. | 439/374 |
| 6,346,007 | B2 * | 2/2002 | Yokoi | 439/564 |
| 6,411,526 | B1 | 6/2002 | Nguyen et al. | |
| 6,435,897 | B1 * | 8/2002 | Paul et al. | 439/374 |
| 6,494,749 | B1 * | 12/2002 | Chang | 439/701 |
| 6,607,303 | B2 | 8/2003 | Ngo et al. | |
| 6,921,281 | B2 * | 7/2005 | Chen | 439/447 |
| 7,708,589 | B2 | 5/2010 | Shuey | |
| 2003/0171033 | A1 | 9/2003 | Bright | |
| 2007/0287332 | A1 | 12/2007 | Gordon et al. | |
| 2009/0247006 | A1 * | 10/2009 | Thompson | 439/527 |

FOREIGN PATENT DOCUMENTS

JP 08-255512 A 10/1996

OTHER PUBLICATIONS http://www.molex,com/molex/products/family?channel=products&chanName=family&pageTitle=introduction&key=extreme_poweredge , EXTreme PowerEdge™: EXTreme PowerEdge™ connectors with signal contacts for combined high-power and signal card edge or busy bar tab applications, printed Feb. 25, 2010, 1 page.

http://www.molex.com/molex/products/family?channel=products&chanName=family&pageTitle=Introduction&key=extreme_lphpower, EXTreme LPHPower™ Low-Profile Hybrid Power Connector: High-current, low-profile EXTreme LPHPPower™ connector extends mounting flexibility to backplane or midplane mating applications, printed Feb. 25, 2010, 1 page.

* cited by examiner

*Primary Examiner* — Briggitte R Hammond
(74) *Attorney, Agent, or Firm* — Woodcock Washburn LLP

(57) ABSTRACT

An electrical connector system configured to be attached to a support structure is disclosed. The electrical connector system may include a mount capable of being attached to the support structure. The mount may include a bezel and a flange. The bezel may define a first opening, a second opening and aperture. The flange may be integrally formed with and extending outwardly from the bezel. The first opening may be capable of receiving a first power connector and the second opening is capable of receiving a second power connector. The second power connector is capable of extending into the aperture of the bezel such that the first and second power connectors mate.

14 Claims, 12 Drawing Sheets

CABLE PANEL MOUNT

BACKGROUND

This invention relates generally to electrical connectors. Generally, power cable connectors mate with board mounted headers or other power cables to transfer power from a power source to a load. For example, the assignee of this invention, FCI America Technologies, Inc. (FCI) sells power cable connectors under the trade names PwrBlade® and Pwr TwinBlade™.

FCI's Pwr TwinBlade™ connector is designed to support applications that demand the supply of high power, including currents of up to 100 Amps per twin-contact. The Pwr Twin Blade™ connector can be mated with either a straight or a right-angled board connector to form a connector system.

Because these connectors support such high currents there is a need for a mount that assists in the mating of two connectors. For example, such high currents may create a hazard for individuals handling the connectors. Therefore, it may be desirable to have a mount that may help support the connectors, may make the mated connectors inaccessible, and may allow the connectors to be placed one at a time. Furthermore, it may also be desirable that the mount be configured to minimizes space used where space constraints exist.

SUMMARY

A mount for an electrical connector system is disclosed. The mount may assist in the mating of two power connectors.

In one embodiment the mount may be configured to be attached to a panel having a first face, a second face and an aperture extending between the first and second faces. The mount may include a bezel and a raised portion. The bezel may extend away from the first face of the panel when the mount is attached to the panel. The raised portion may extend into the aperture of the panel such that a face of the raised portion is substantially flush with the second surface of the panel when the mount is attached to the panel. The raised portion may define a first opening, the bezel may define a second opening and an aperture may extend between the first and second openings. The first opening may be capable of receiving a first power connector having a first connector housing, and at least one power contact housed within the first connector housing. The second opening may be capable of receiving a second power connector having a second connector housing, and at least one power contact housed within the second connector housing. The second power connector may extend into the aperture of the mount such that the first power connector mates with the second power connector.

In another embodiment the mount may be configured to be attached to a support structure. The mount may include a bezel and a flange. The bezel may define a first opening, a second opening and an aperture that may extend between the first and second openings. The flange may extend outwardly from the bezel. The first opening may be capable of receiving a first power connector having a first connector housing, and at least one power contact housed within the first connector housing. The second opening may be capable of receiving a second power connector having a second connector housing, and at least one power contact housed within the second connector housing. The second power connector may extend into the aperture of the bezel such that the first power connector mates with the second power connector. The bezel may cover the mated first and second power connectors such that the power contacts of the first and second power connectors are inaccessible.

In another embodiment the mount is part of an electrical connector system that may be configured to be attached to a support structure. The mount may include a bezel and a flange. The bezel may define a first opening, a second opening and an aperture extending between the first and second openings. The flange may be integrally formed with and extending outwardly from the bezel. The first opening may be capable of receiving a first power connector having a first connector housing that defines a header mating end, and at least one power contact housed within the first connector housing. The second opening may be capable of receiving a second power connector having a second connector housing that defines a receptacle mating end, and at least one power contact housed within the second connector housing. The second power connector may be capable of extending into the aperture of the bezel such that the receptacle mating end receives the header mating end.

DETAILED DESCRIPTION OF ILLUSTRATIVE EMBODIMENTS

Figure 1:
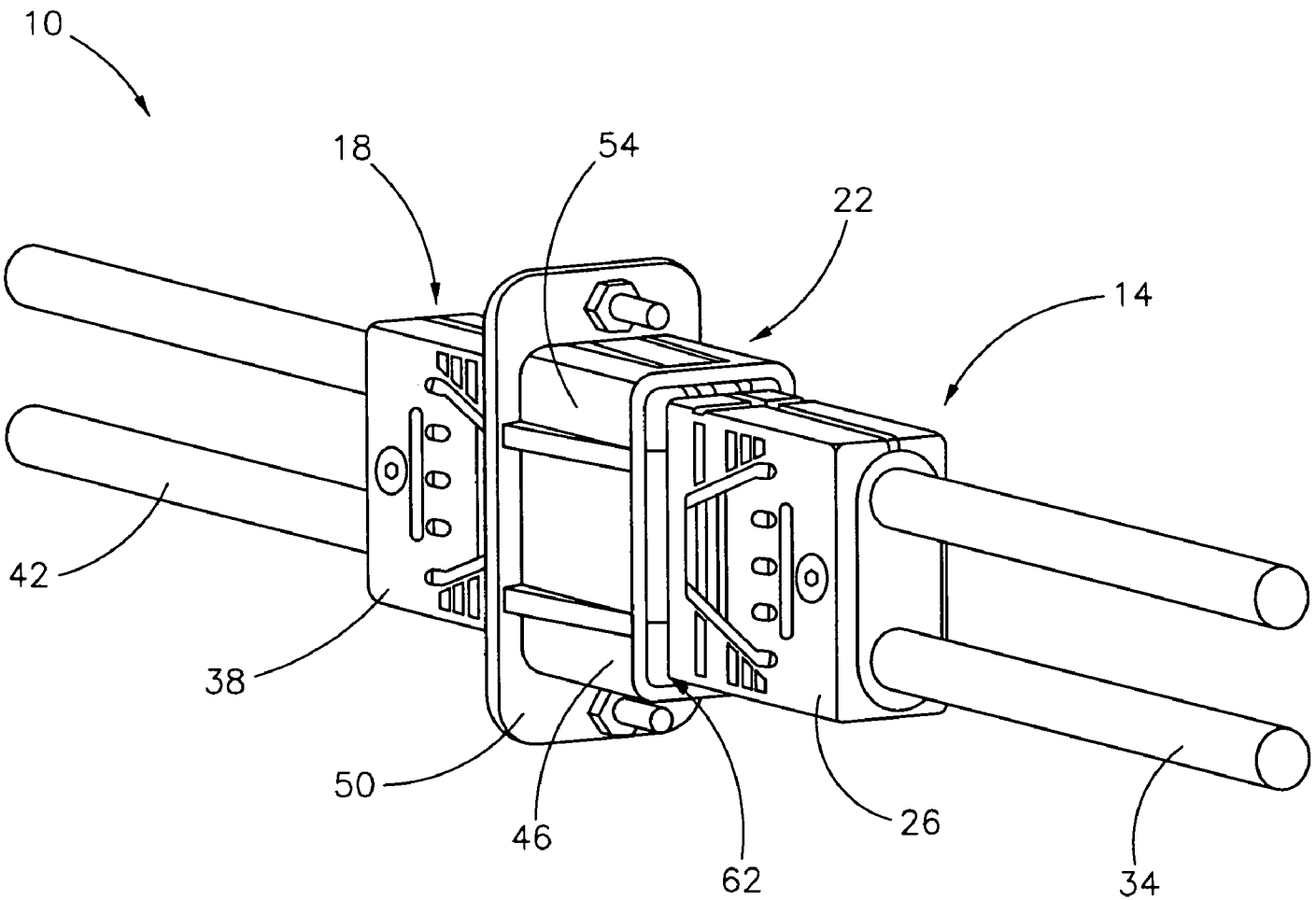
FIG. 1 is a perspective view of an electrical connector system including a first power connector mated with a second connector, wherein both connectors are supported by a mount.

Referring to FIG. 1, an electrical connector system 10 includes a first power connector 14, a second power connector 18 and a mount 22. The electrical connector system 10, and in particular the mount 22, is configured to be attached to a support structure. The mount 22 can be configured to assist in the mating of the first and second power connectors 14 and 18, and can be further configured to support the first and second power connectors when the connectors are mated. Once mount 22 is attached to the support structure, first power connector 14 may be inserted into mount 22 in a first direction and second power connector 18 may be inserted into mount 22 in a second direction opposite the first direction to thereby mate with first power connector 14.

First power connector 14 includes a first connector housing 26, power contacts 30 (shown in FIG. 2A) and cables 34. First connector housing 26 may define a receptacle mating end or a header mating end so long as first power connector 14 can mate with second power connector 18. Power contacts 30 are housed within first connector housing 26 and are electrically connected to cables 34. As shown, cables 34 may extend out from a back side of first connector housing 26.

Similarly, second power connector 18 includes a second connector housing 38, power contacts (not shown) and cables 42. Like first contact housing 26, second connector housing 38 may define a receptacle mating end or a header mating end so long as first power connector 14 can mate with second power connector 18. The power contacts for second power connector 18 are housed within second connector housing 38 and may be adapted to mate with power contacts 30 of first power connector 14. As shown, cables 42 may extend out from a back side of second connector housing 38.

In accordance with one embodiment, the first and second power connectors 14 and 18 can be provided as PwrBlade® electrical connectors or Pwr TwinBlade™ electrical connectors, commercially available from FCI, having a place of business located in Etters, Pa., or any other electrical connectors as desired.

Figure 2A:
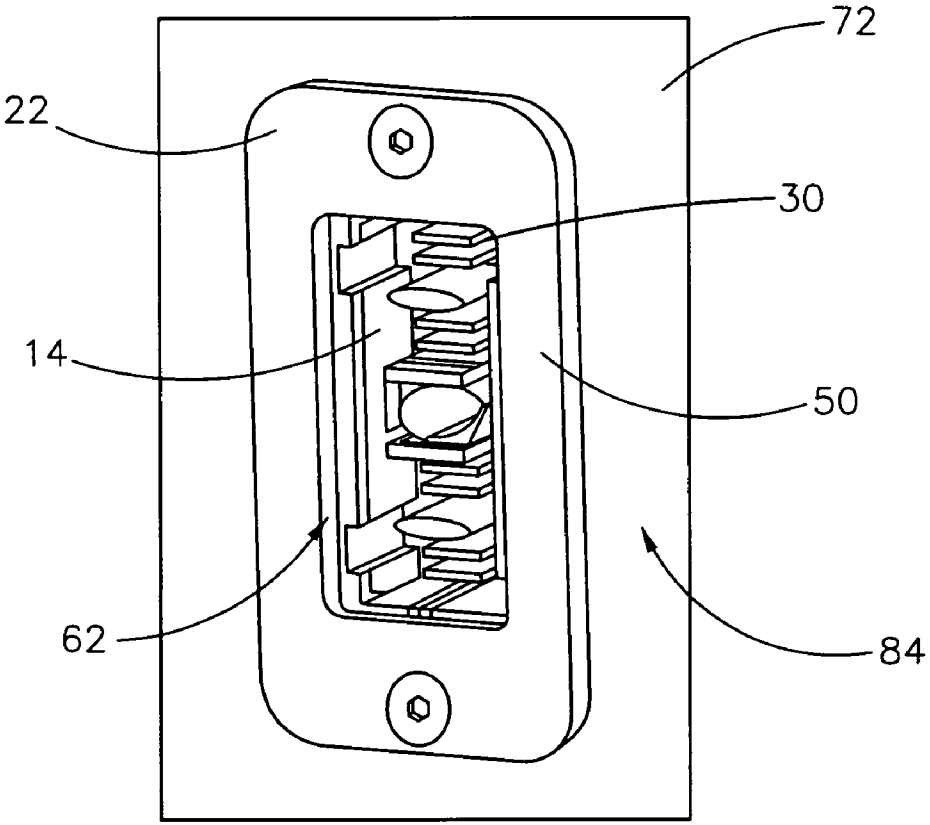
FIG. 2A is a front perspective showing the first power connector supported by the mount of FIG. 1, wherein the mount is attached to a support structure.
Figure 2B:
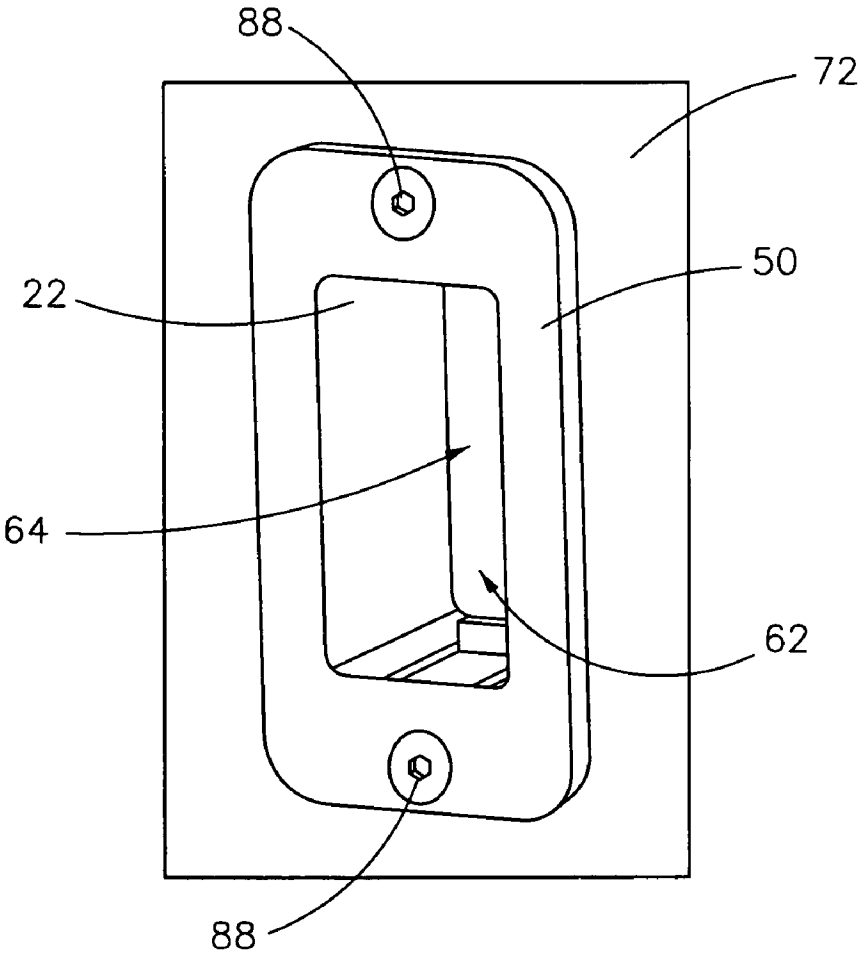
FIG. 2B is a front perspective view of the mount shown in FIG. 2A with the first power connector removed for clarity.
Figure 2C:
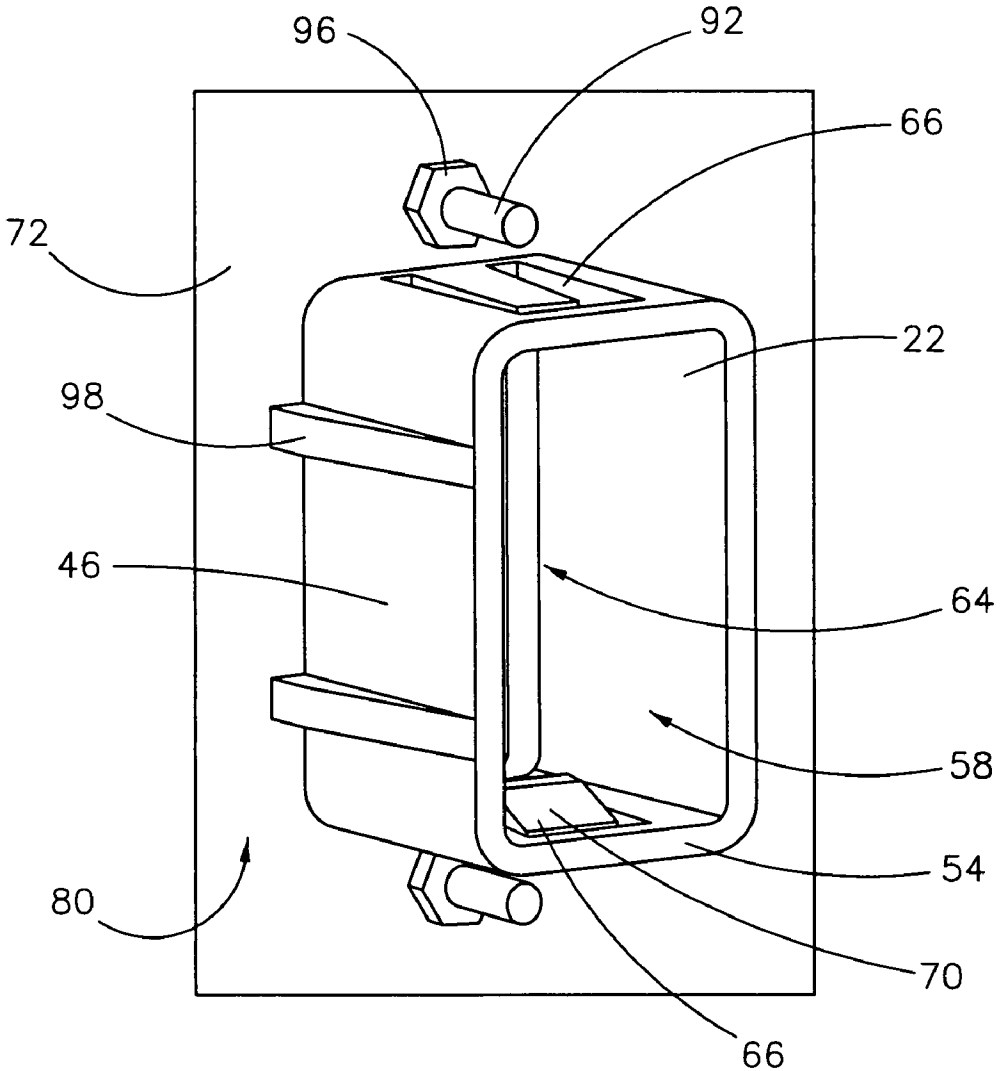
FIG. 2C is a back perspective view of the mount shown in FIG. 2B.

As shown in FIGS. 1-2C, mount 22 includes a generally longitudinally elongate bezel 46 and a flange 50 that can be integrally formed with bezel 46 and extending laterally outwardly from bezel 46. The flange 50 extends from one end of bezel 46, though it should be appreciated that flange 50 could extend from bezel 46 at any location between the opposing outer ends of bezel 46, including locations at the outer ends of bezel 46. As shown, bezel 46 includes four connected side walls 54 that define a first opening 58, a second opening 62 opposite opening 58, and a longitudinally elongate channel or aperture 64 that extends between the first and second openings. The walls 54 can be longitudinally elongate, and can further flare laterally outward in along a direction from the second opening 62 toward the first opening 58. It should be appreciated that while the four connected side walls 54 define a rectangular cross section as illustrated, they may alternatively define any suitably shaped cross-section. In this regard, the openings 58 and 62, and the aperture 64 can be defined by at least one side wall.

Therefore, first power connector 14 can be received in first opening 58 and second power connector 18 can be received in second opening 62. As the first and second power connectors 14 and 18 are inserted longitudinally inward inside the aperture 64, the connectors can mate at a location inside the aperture 64. When the power connectors 14 and 18 are connected together, bezel 46 may create a barrier that makes the power contacts of the power connectors inaccessible to human touch. Thus, mount 22 may make electrical connector system 10 touch proof. It should be appreciated that first power connector 14 may alternatively be received in second opening 62 and second power connector 18 may be received in first opening 58.

Referring now to FIG. 2C, mount 22 may include opposing engagement members in the form of latches 66 that are carried by bezel 46. In particular, a latch 66 may be formed in opposing walls 54 of bezel 46 at a location inside the aperture 64. Each latch 66 may be deflectable and may include a protrusion 70 that extends from the respective side wall 54 and into aperture 64 along a longitudinal direction from the opening 58 toward the opposing opening 62. Accordingly, when first power connector 14 (or second power connector 18) is inserted into first opening 58 and thus aperture 64, latches 66 may initially deflect out and then may deflect back in to thereby securely hold first power connector 14 in place. Though not shown, protrusions 70 of latches 66 can mate with, or be received by, corresponding engagement members of the power connector 14 in the form of recesses that are formed in first connector housing 26 to securely hold the first power connector 14 in the aperture 64. Alternatively, the bezel may include recesses that mate with complementary latches carried by the connector housing 26. FIG. 2A shows first power connector 14 after it has been inserted into first opening 58 of bezel 46. As shown, first power connector 14 may extend into aperture 64 such that its mating face is proximate to second opening 62 of bezel 46, or closer to the second opening 62 than the first opening 58.

Bezel 46 may also have a longitudinal length that is sufficient to support first power connector 14 after it has been inserted. Further, latches 66 may securely hold first power connector 14 such that once first power connector 14 is secured in place, second power connector 18 may be inserted into second opening 62 to connect second power connector 18 with first power connector 14 without having to manually support first power connector 14 during the connecting of the two connectors. As will be understood by those skilled in the art, latches 66 are not required, and bezel 46 may be sized to create a frictional fit between walls 54 and first connector housing 26 after first power connector 14 has been inserted into first opening 58.

Referring to FIGS. 2A-C, mount 22 may be attached to a support structure 72 that presents opposing first and second faces 80 and 84, respectively. Support structure 72 may be any support structure, such as a panel, for example. As shown, support structure 72 may define an aperture extending longitudinally therethrough, and bezel 46 may extend through the aperture such that bezel 46 extends away from first face 80 of support structure 72. When mount 22 is attached to support structure 72, flange 50 may abut second face 84 of support structure 72. As shown, fasteners 88 may be used to securely hold electrical connector system 10 in place. In the embodiment shown, fasteners 88 each include a bolt 92 that extends through both flange 50 of mount 22 and support structure 72 and a nut 96 may then be screwed onto each bolt 92.

As shown in FIG. 2C, bezel 46 may include rails 98 to help guide mount while it is being attached to the support structure and to help support bezel 46. In the illustrated embodiment, the rails 98 project out from opposing walls 54 in a direction from the first opening 58 toward the second opening 62. Rails 98 may be inwardly deflectable so as to lock bezel 46 onto the support structure.

Referring now to FIGS. 3A-3D, a mount 100, constructed in accordance with an alternative embodiment and usable in combination with the connector system 10 described above, includes a bezel 104, a flange 108 that can be integrally formed with the bezel 104 and extending laterally outwardly from bezel 104 and a platform 110 extending out from flange 108. As shown, bezel 104 includes four connected side walls 112 that define a first opening 116, a second opening 120 opposite the first opening 116, and a longitudinally elongate channel or aperture 124 that extends between the first and second openings. The walls 112 can be longitudinally elongate, and can further flare laterally outward in along a direction from the first opening 116 toward the second opening 120. It should be appreciated that while the four connected side walls 112 define a rectangular cross section as illustrated, they may alternatively define any suitably shaped cross-section. In this regard, the openings 116 and 120, and the aperture 124 can be defined by at least one side wall.

The platform 110 can be spaced from the bezel 104 at a location proximate to the flange 108, and can connect to the bezel 104 at a location proximate to the first opening 116. The first power connector 14 can be received by first opening 116 and second power connector 18 can be received by second opening 120 so that the first and second power connectors can be connected together in the manner described above with respect to mount 22.

Figure 3A:
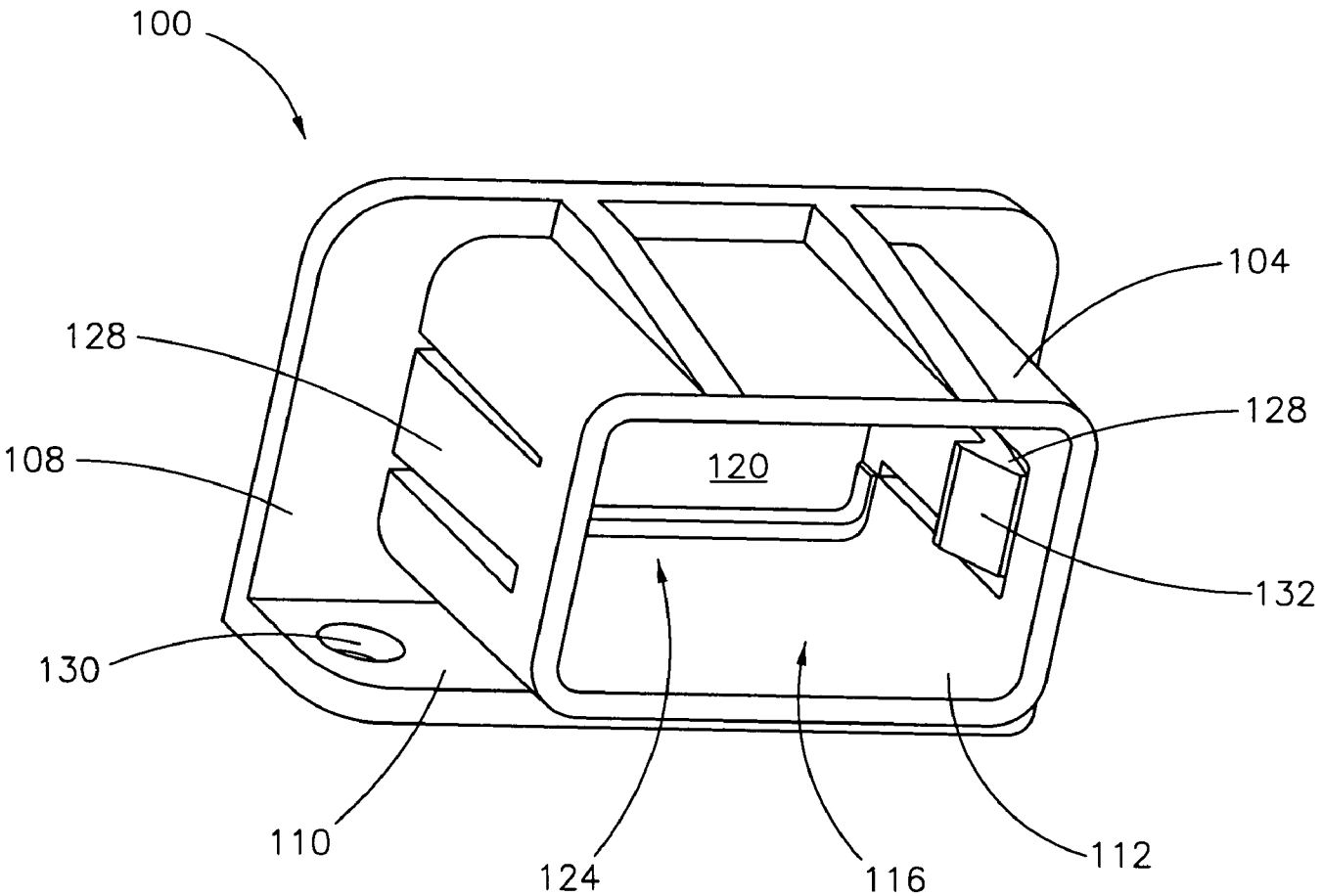
FIG. 3A is a perspective view of a mount constructed in accordance with an alternative embodiment.
Figure 3B:
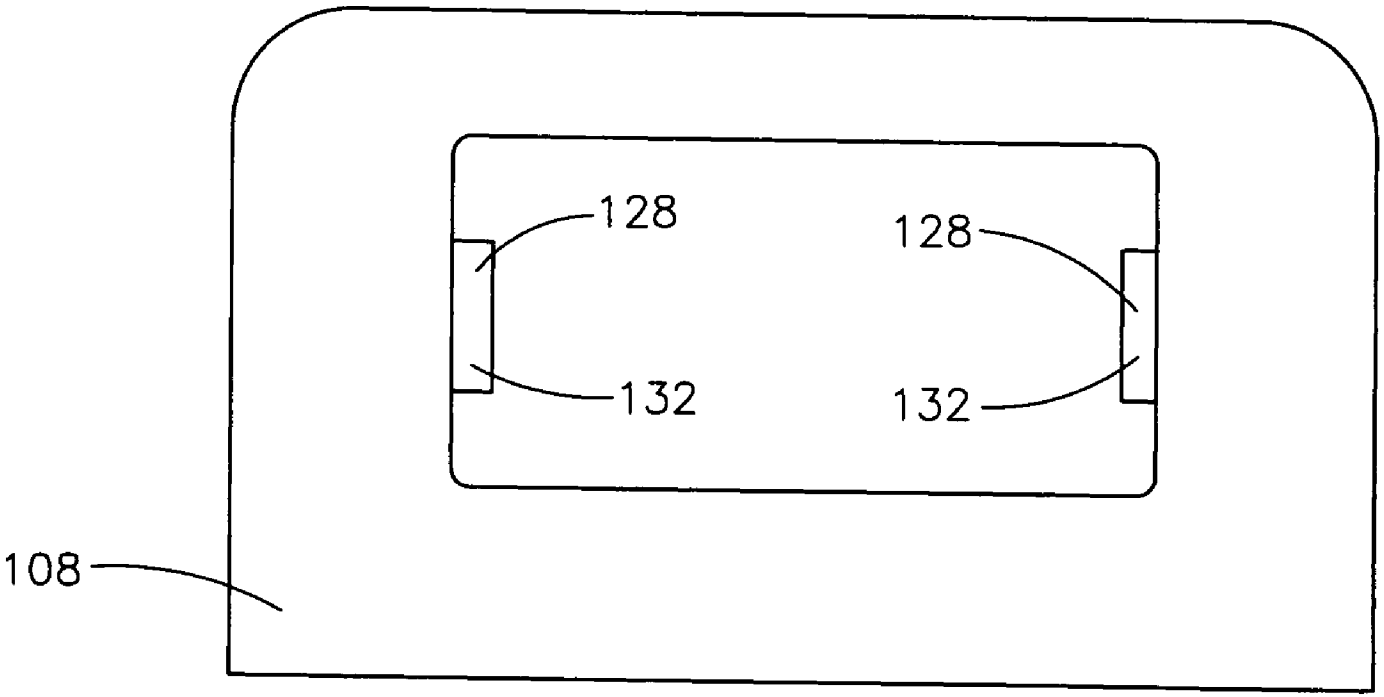
FIG. 3B is a front elevation view of the mount shown in FIG. 3A.
Figure 3C:
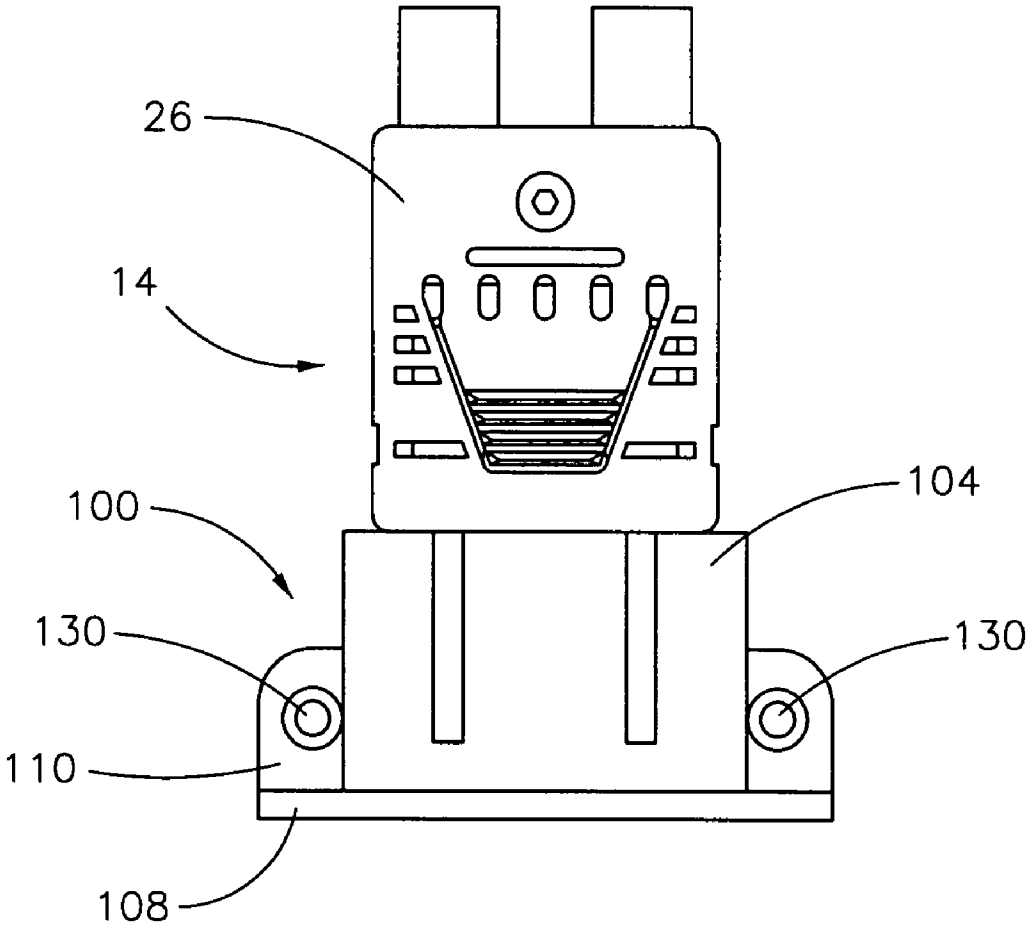
FIG. 3C is a top plan view of the mount shown in FIG. 3A with a first power connector supported by the mount.

Referring now to FIGS. 3A and 3B, mount 100 may include opposing engagement members in the form of latches 128 that are carried by the bezel 104. In particular, a latch 128 may be formed in opposing walls 112 of bezel 104 at a location inside the aperture 124. Each latch 128 may be deflectable and may include a protrusion 132 that extends from the respective side wall 112 and into aperture 124 along a longitudinal direction from the opening 116 toward the opposing opening 120. Accordingly, when first power connector 14 is inserted into first opening 116 and thus aperture 124, latches 128 may initially deflect out and then may deflect back in to thereby securely hold first power connector 14 in place. Though not shown, protrusions 132 of latches 128 can mate with, or be received by, corresponding engagement members of the power connector 14 in the form of recesses that are formed in first connector housing 26 to securely hold the first power connector 14 in the aperture 124. Alternatively, the bezel may include recesses that mate with complementary latches carried by the connector housing 26. FIG. 3C shows first power connector 14 after it has been inserted into first opening 116 of bezel 104.

Figure 3D:
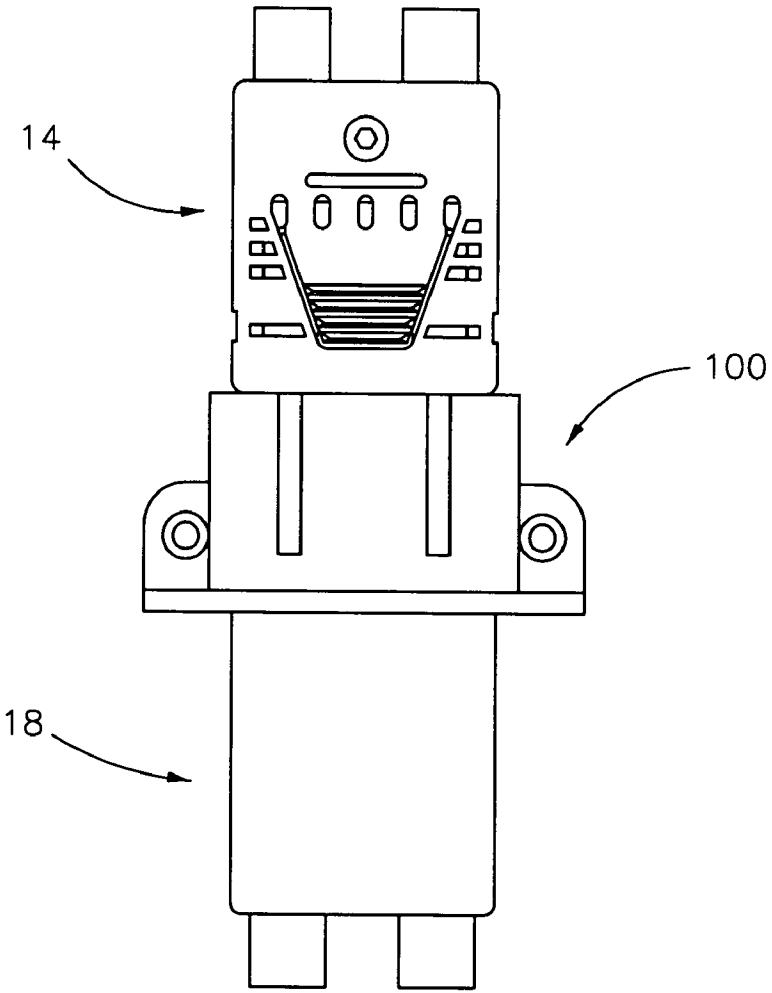
FIG. 3D is a top view of the mount shown in FIG. 3C with a second power connector supported by the mount.

Bezel 104 may have a longitudinal length that is sufficient to support first power connector 14 after it has been inserted. Further, latches 128 may securely hold first power connector 14 such that once first power connector 14 is secured in place, second power connector 18 may be inserted into second opening 120 to connect second power connector 18 with first power connector 14 without having to manually support first power connector 14 during the connecting of the two connectors. FIG. 3D shows first power connector 14 attached to second power connector 18 with both connectors being supported by mount 100. Like mount 22, latches 128 are not required and bezel 104 may be sized to create a frictional fit between walls 112 and first connector housing 26 after first power connector 14 has been inserted into first opening 116.

As shown in FIGS. 3A, 3C and 3D, platform 110 extends from flange 108 and includes two holes 130 so that mount 100 may be attached to a support structure using any desired fastener. As shown, platform 110 extends from a bottom or outer edge of flange 108. Therefore when platform 110 is attached to a support structure, bezel 104 and thus first power connector 14 and second power connector 18 may extend substantially parallel to the support structure.

Referring now to FIGS. 4A-4D a mount 200, constructed in accordance with another alternative embodiment an usable in combination with the connector system 10 described above, includes a bezel 204, a flange 208 that can be integrally formed with the bezel 104 and extend laterally outwardly from bezel 104 and a raised portion 210 extending longitudinally out from flange 208. As shown, bezel 204 includes four connected side walls 212 that define a first opening 216, a second opening 220 and a longitudinally elongate channel or aperture that extends longitudinally between the first and second openings in the manner described above. The side walls 212 can be longitudinally elongate, and can further flare laterally outward in along a direction from the first opening 216 toward the second opening 220. It should be appreciated that while the four connected side walls 212 define a rectangular cross section as illustrated, they may alternatively define any suitably shaped cross-section. In this regard, the openings 216 and 220, and the aperture can be defined by at least one side wall. The first power connector 14 can be received by first opening 216 and second power connector 18 can be received by second opening 220 so that the first and second power connectors can be connected together in the manner described above with respect to mount 22.

Figure 4A:
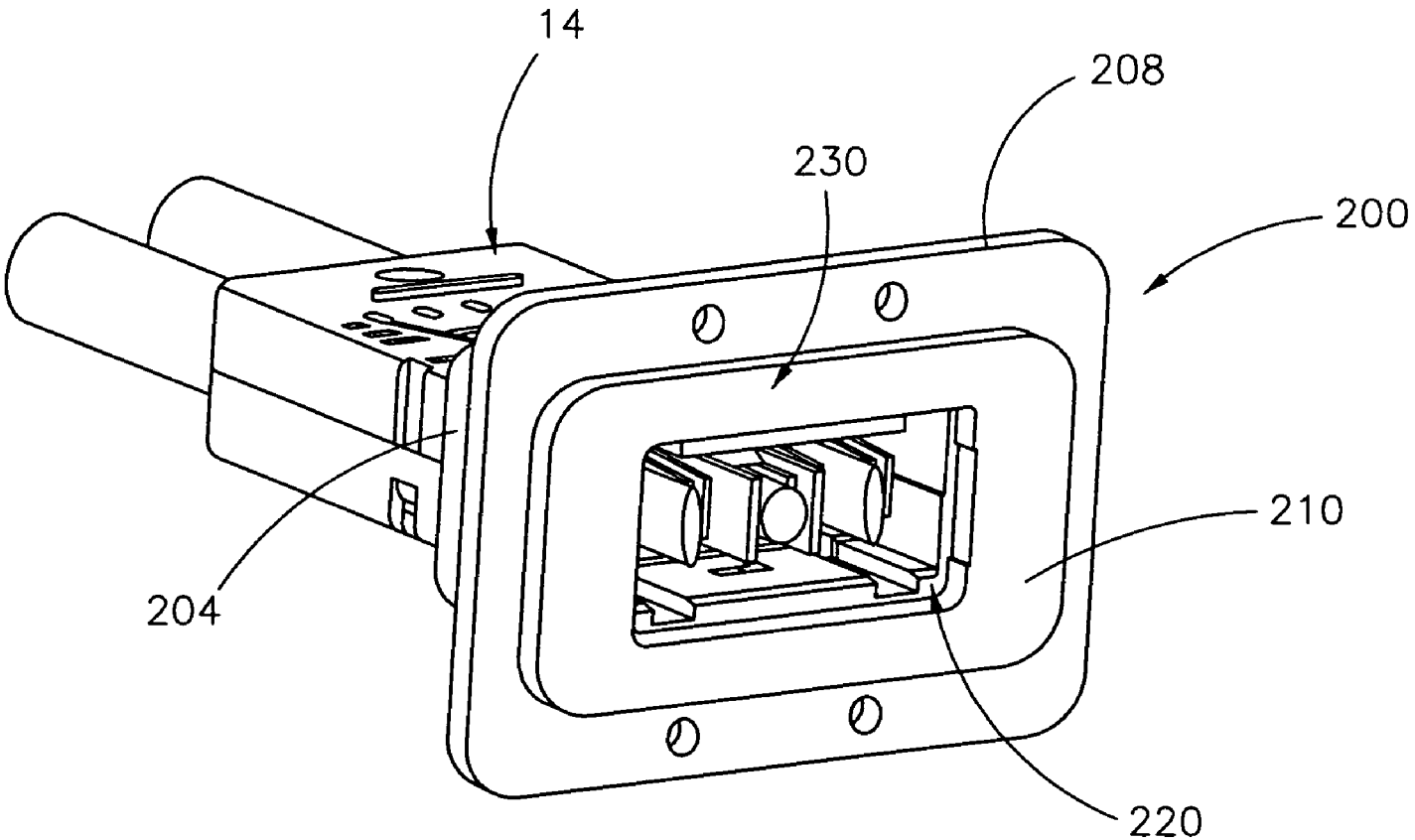
FIG. 4A is a front perspective view of a mount constructed in accordance with another alternative embodiment, with a first power connector supported by the mount.
Figure 4B:
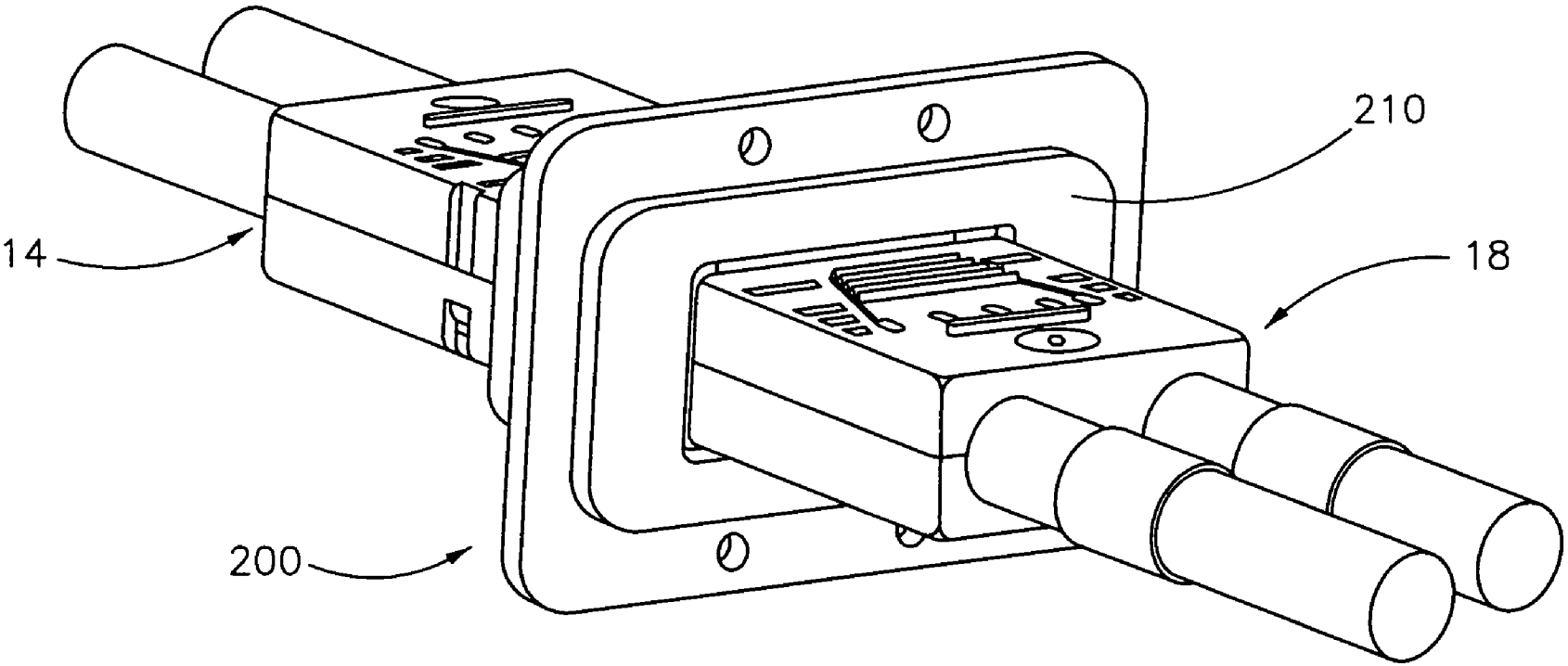
FIG. 4B is a front perspective view of the mount shown in FIG. 4A with a second power connector supported by the mount.
Figure 4C:
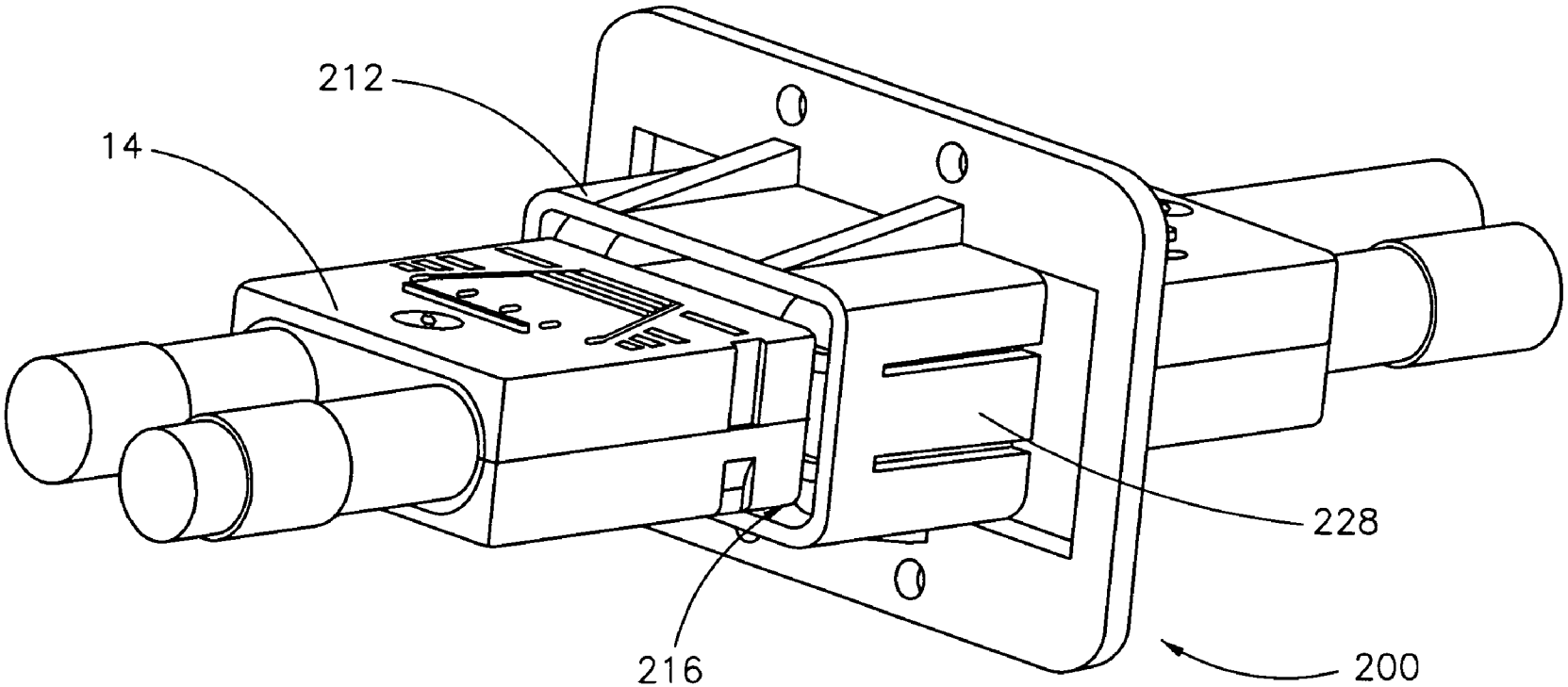
FIG. 4C is a back perspective view of the mount shown in FIG. 4B.
Figure 4D:
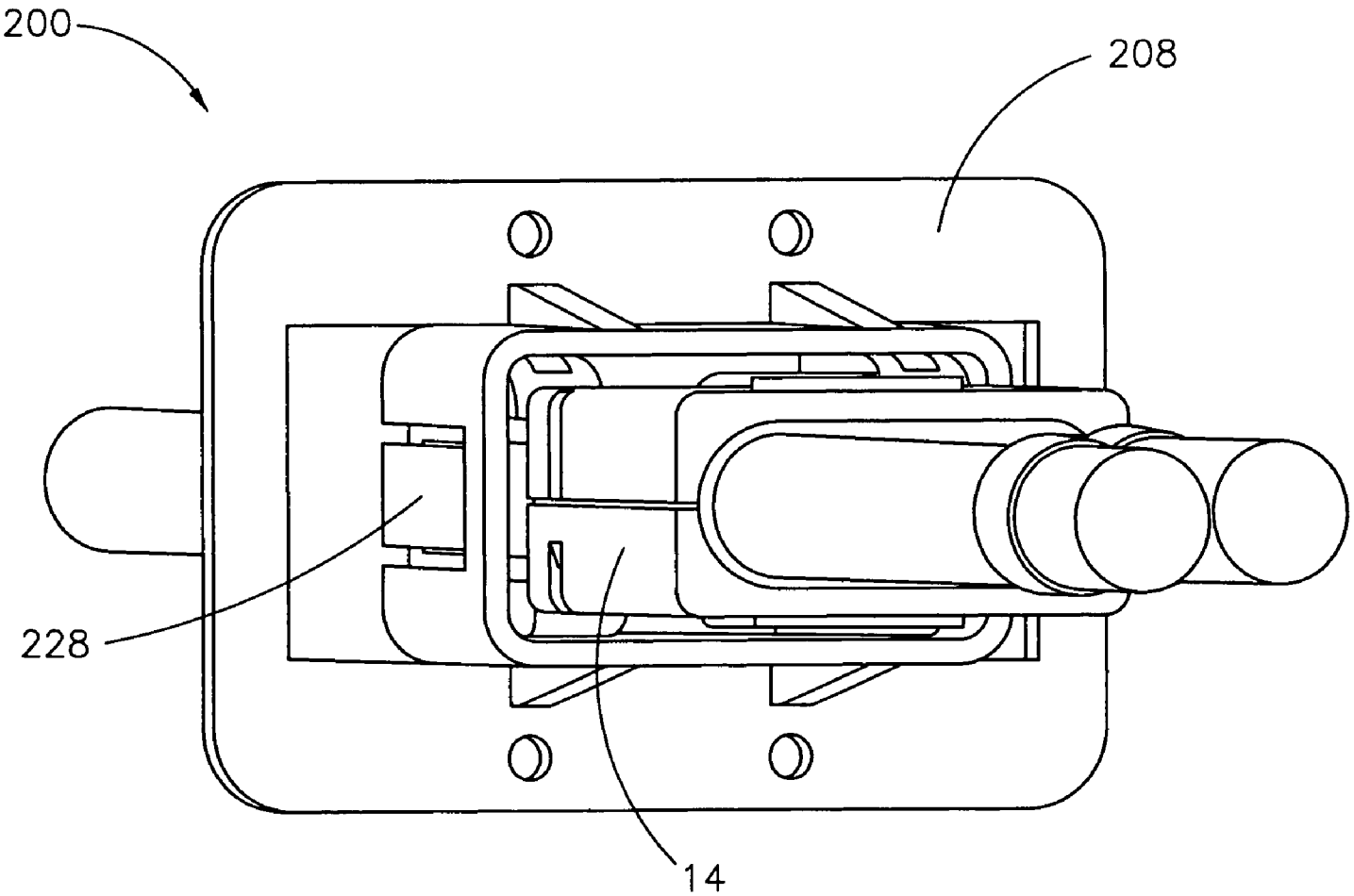
FIG. 4D is another back perspective view of the mount shown in FIG. 4B.

As more clearly shown in FIGS. 4C and 4D, mount 200 may include engagement members in the form of latches 228 that are carried by the bezel 204. In particular, a latch 228 may be formed in opposing walls 212 of bezel 204 at a location inside the aperture. Each latch 228 may be deflectable and may include a protrusion that extends into the aperture in the manner described above. Accordingly, when first power connector 14 is inserted into first opening 216 and thus the aperture, latches 228 may initially deflect out and then may deflect back in to thereby securely hold first power connector 14 in place. Though not shown, the protrusions of latches 228 can mate with, or be received by, corresponding engagement members of the power connector 14 in the form of recesses that are formed in first connector housing 26 to securely hold the first power connector 14 in the aperture. Alternatively, the bezel may include recesses that mate with complementary latches carried by the connector housing 26. FIG. 4A shows first power connector 14 after it has been inserted into first opening 216 of bezel 204.

Bezel 204 may have a longitudinal length that is sufficient to support first power connector 14 after it has been inserted. Further, latches 228 may securely hold first power connector 14 such that once first power connector 14 is secured in place, second power connector 18 may be inserted into second opening 220 to connect second power connector 18 with first power connector 14 without having to manually support first power connector 14 during the connecting of the two connectors. FIGS. 4B, 4C and 4D show first power connector 14 attached to second power connector 18 with both connectors being supported by mount 200. Like mount 22, latches 228 are not required, and bezel 204 may be sized to create a frictional fit between walls 212 and first connector housing 26 after first power connector 14 has been inserted into first opening 216.

As shown in FIGS. 4A and 4B, raised portion 210 extends from flange 208 proximate to and around second opening 220. Thus, the raised portion 210 can circumscribe the second opening 220. In one embodiment, raised portion 210 extends a distance from flange 208 such that an outer lateral surface 230 of raised portion 210 is flush with a surface of the support structure when mount 200 is attached to the support structure (such as the support structure 72 as described above). Thus, the raised portion 210 can extend a longitudinal distance substantially equal to the thickness of the support structure. That is, when mount 200 is mounted to a support structure, raised portion 210 extends through an aperture of the support structure such that surface 230 is flush with a first surface of the support structure, and flange 208 abuts an opposing second surface of the support structure. Accordingly, mount 200 may be used where space constraints exist.

It should further be noted that the embodiments described herein have been provided by way of example, and the scope present invention is not intended to be limited to the embodiments described herein. For instance, it should be appreciated that the principles of the present invention could be applied to connectors other than cable connectors. Likewise, it should be appreciated that the principles of the present invention could be applied to provide a mount having a combination of features from each mount described. In order to apprise the public of the scope of the present application, the following claims are presented.

What is claimed:

1. An electrical connector system configured to be attached to a support structure, the electrical connector system comprising:

a mount capable of being attached to the support structure, the mount comprising:

a bezel defining a first opening, a second opening and an aperture extending between the first and second openings, and a flange integrally formed with and extending outwardly from the bezel;

wherein (i) the first opening receives a first power connector having a at least one power contact, (ii) the second opening receives a second power connector having at least one power contact such that the at least one power contact of the first power connector mates with the at least one power contact of the second power connectors in the aperture of the bezel, (iii) the support structure has a first face, a second face and an aperture extending between the first and second faces, and (iv) the mount attaches to the support structure such that the flange abuts the first face of the support structure and the aperture of the bezel extends through the aperture of the support structure.

2. The electrical connector system of claim 1, wherein (i) the mount further comprises a platform extending from the flange, and (ii) the platform is fastened to the support structure.

3. The electrical connector system of claim 1, wherein (i) the mount further comprises a raised portion extending from a face of the flange, and (ii) the raised portion extends through the aperture of the support structure.

4. The electrical connector system of claim 3, wherein the face of the raised portion is flush with the second face of the support structure.

5. The electrical connector system of claim 3, wherein the bezel and the raised portion are capable of covering the mated first and second power connectors such that the power contacts are inaccessible.

6. The electrical connector system of claim 1, further comprising the first and second power connectors.

7. The electrical connector system of claim 6, wherein the bezel includes at least one latch disposed in the aperture that securely holds the second power connector in place after the second power connector has been received in the aperture.

8. A mount configured to be attached to a panel having a first face, a second face and an aperture extending between the first and second faces, the mount comprising:

a raised portion that extends into the aperture of the panel such that a face of the raised portion is substantially flush with the second surface of the panel when the mount is attached to the panel, the raised portion defining a first opening that receives a first power connector having at least one power contact; and a bezel that extends away from the first face of the panel when the mount is attached to the panel, the bezel defining a second opening that receives a second power connector having at least one power contact, wherein the mount defines an aperture extending between the first and second openings, such that the at least one power contact of the first power connector mates with the at least one power contact of the second power connector in the aperture.

9. The mount of claim 8, further comprising a flange that extends outwardly from the bezel.

10. The mount of claim 8, wherein the bezel and raised portion are capable of covering the mated first and second power connectors such that the power contacts of the first and second power connectors are inaccessible.

11. The mount of claim 8, wherein the bezel includes at least one latch disposed in the aperture, wherein the latch securely holds the second power connector in place after the second power connector has been received in the aperture.

12. The mount of claim 11, wherein the bezel includes at least one latch disposed in the aperture, wherein the latch securely holds the second power connector in place after the second power connector has been received in the aperture.

13. A mount configured to be attached to a panel, the mount comprising:

a bezel defining a first opening that receives a first power connector having at least one power contact, a second opening that receives a second power connector having at least one power contact, and an aperture extending between the first and second openings; and a flange extending outwardly from the bezel and configured to be mounted onto the panel, and a raised portion extending from a first face of the flange, wherein the raised portion extends through an aperture of the panel when the mount is attached to the panel, wherein the first and second power connectors mate in the aperture of the bezel such that the bezel covers the at least one power contact of the first power connector and the at least one power contact of the second power connector so as to inhibit access to the at least one power contact of the first power connector and the at least one power contact of the second power connector.

14. A mount configured to be attached to a panel, the mount comprising:

a bezel defining a first opening that receives a first power connector having at least one power contact, a second opening that receives a second power connector having at least one power contact, and an aperture extending between the first and second openings; and a flange extending outwardly from the bezel and configured to be mounted onto the panel, and a platform extending from the flange, wherein the first and second power connectors mate in the aperture of the bezel such that the bezel covers the at least one power contact of the first power connector and the at least one power contact of the second power connector so as to inhibit access to the at least one power contact of the first power connector and the at least one power contact of the second power connector.

* * * * *